264-323
2/11/86 4,569,815

United States Patent [19]

Rentz et al.

[11] Patent Number: 4,569,815

[45] Date of Patent: Feb. 11, 1986

[54] METHOD AND DEVICE FOR SIMULTANEOUSLY PROPELLING AND FORMING IMPRESSIONS WITH A FLOWABLE MATERIAL

[76] Inventors: Robert I. Rentz; Edward J. Rentz, both of 1818 Devils Back Bone Rd., Cincinnati, Ohio 45238

[21] Appl. No.: 506,205

[22] Filed: Jun. 20, 1983

[51] Int. Cl.[4] ..... B29F 3/00

[52] U.S. Cl. ..... 264/323; 264/310; 425/127; 425/183; 425/190; 425/192 R; 425/425; 425/367

[58] Field of Search ..... 425/127, 183, 190, 192 R, 425/376 R, 201, 429, 425; 264/293, 167, 166, 136; D21/124

[56] References Cited

U.S. PATENT DOCUMENTS

| | | | |
|---|---|---|---|
| 2,578,105 | 12/1951 | Taylor | 425/183 |
| 2,867,001 | 1/1959 | Lewis et al. | 264/167 |
| 3,001,485 | 9/1961 | Czik | 425/190 |
| 3,157,933 | 11/1964 | Boggild et al. | 425/190 |
| 3,262,404 | 7/1966 | Morz et al. | 425/183 |
| 3,264,685 | 8/1966 | Boggild et al. | 425/183 |
| 3,394,431 | 7/1968 | Nalle | 264/167 |
| 3,685,936 | 8/1972 | Meth et al. | 425/376 R |
| 4,076,476 | 2/1978 | Ventura | 425/183 |
| 4,083,666 | 4/1978 | Richardson | 425/183 |

OTHER PUBLICATIONS

*Plastics Engineering,* vol. 36, No. 6, "How to Extrude Embossed Flexible Profiles", Jun. 1980, pp. 34, 35.

*Primary Examiner*—Jay H. Woo
*Assistant Examiner*—M. McGirk
*Attorney, Agent, or Firm*—Kinney and Schenk

[57] ABSTRACT

A device for simultaneously propelling and forming images in a means for receiving with a flowable material consisting of a support structure, a lever, a piston, a means of pivoting the lever about the piston, a storage area for flowable material, a receiving member for receiving flowable material, a means for guiding the receiving member and a means of transferring the flowable material from the storage area to the receiving member. The toy device is used primarily by children to form various images in or on strips of flowable material like Play-Doh ®. A plurality of receiving members are operatable with the toy device and include thin square and rectangular members, rotary disc members, and circular members for both a strip embossing and an animating device. The toy device is capable of multiple modifications for use with the various receiving members.

48 Claims, 48 Drawing Figures

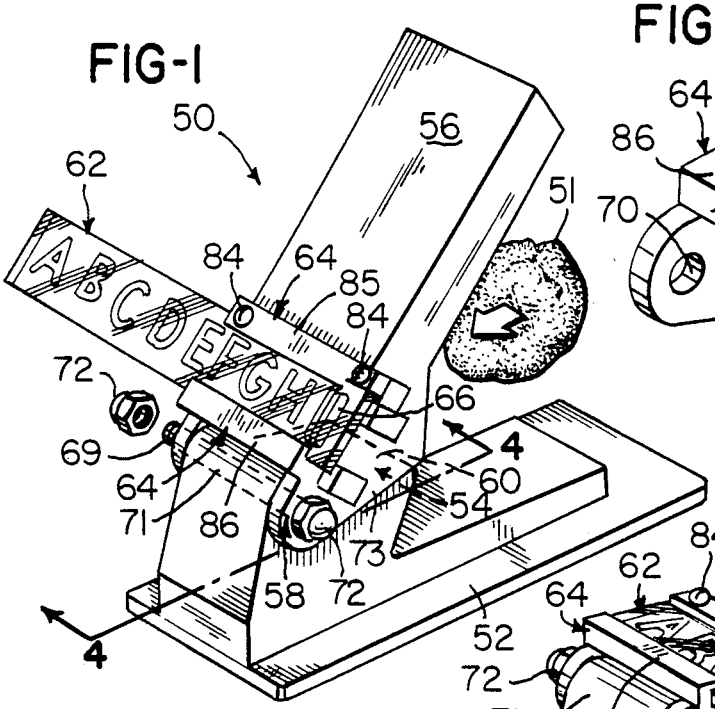
FIG-1
50
56
62
51
84
64
85
84
72
66
69
4
64
60
71
86
54
73
58
72
52
4
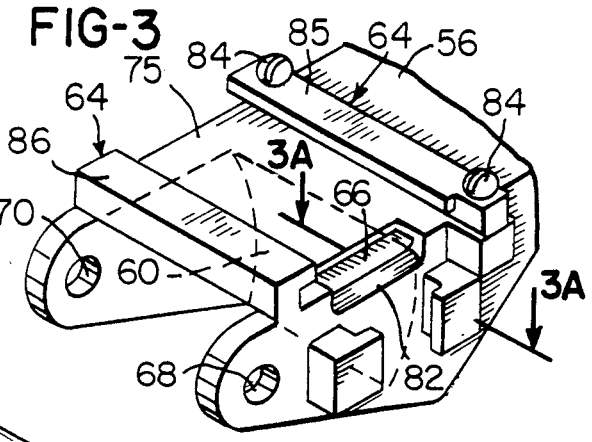
FIG-3
84
85
64
56
75
84
64
86
3A
66
70
60
3A
68
82
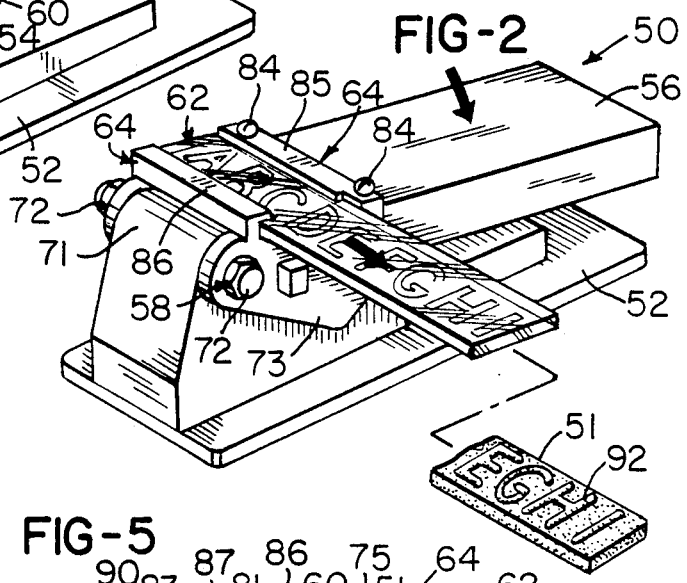
FIG-2
50
84
85
64
56
62
84
64
72
71
86
58
72
73
52
51
92
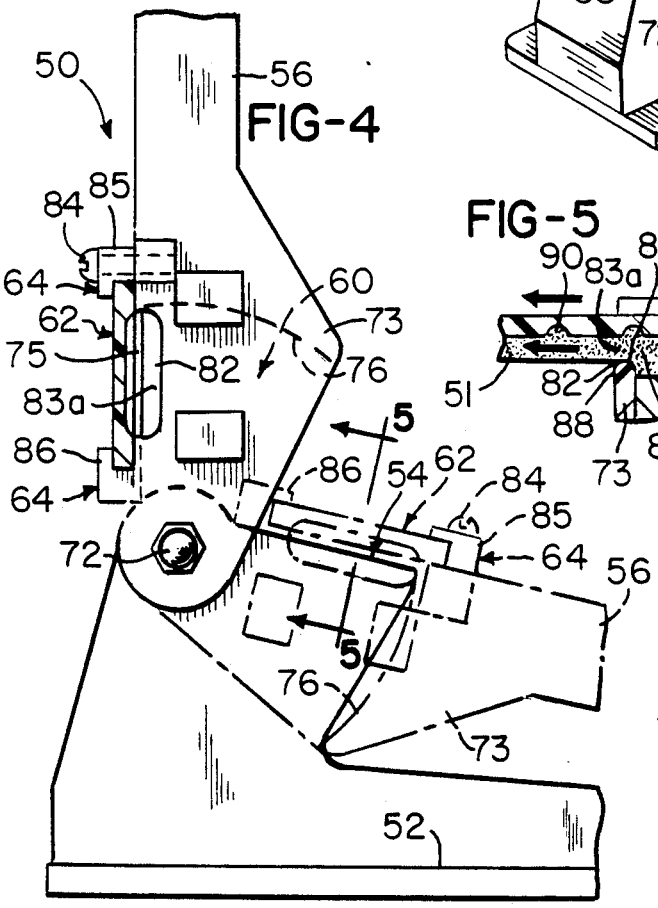
50
56
FIG-4
84
85
64
60
62
73
75
82
76
83a
5
86
64
86
54
62
84
85
72
64
56
5
76
73
52
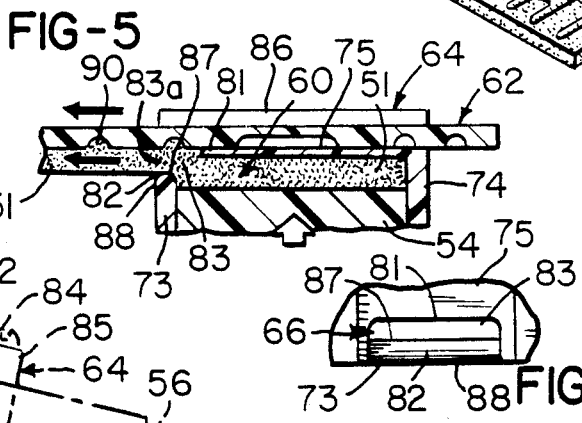
FIG-5
90
83a
87
81
86
60
75
51
64
62
51
82
88
73
83
74
54
75
87
81
83
66
73
82
88
FIG-3A
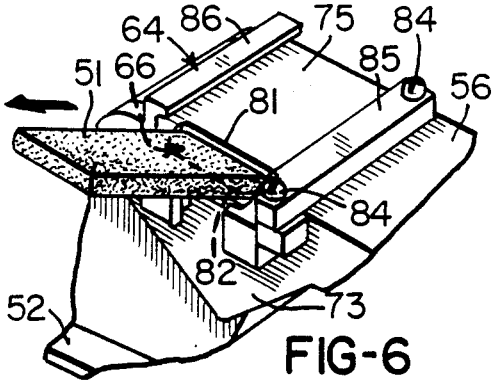
64
86
75
84
51
66
85
56
81
84
82
52
73
FIG-6

181a
90
62
180a
180b
92
91
181b 182a
182b
182c
62
183a
183b
183c
110
91

182d
182e
62
183d
183c
110
91
256

62
64
113
51
50
182
112
52

264
24
262
276
260
51
264
266
250
275
273
254
24
269
271
258
272
252

111
115
116
114

111
116
115
50
75
85
56
64
81
66
86
82
112
73
52

86
64
85
81
115
111
116
66
114
50
112

286
264
285
292
250
281
266
282
283
291
254
290
276

250
262
281
266
292
90
288
273
290
282
91
283
274
291

FIG-32
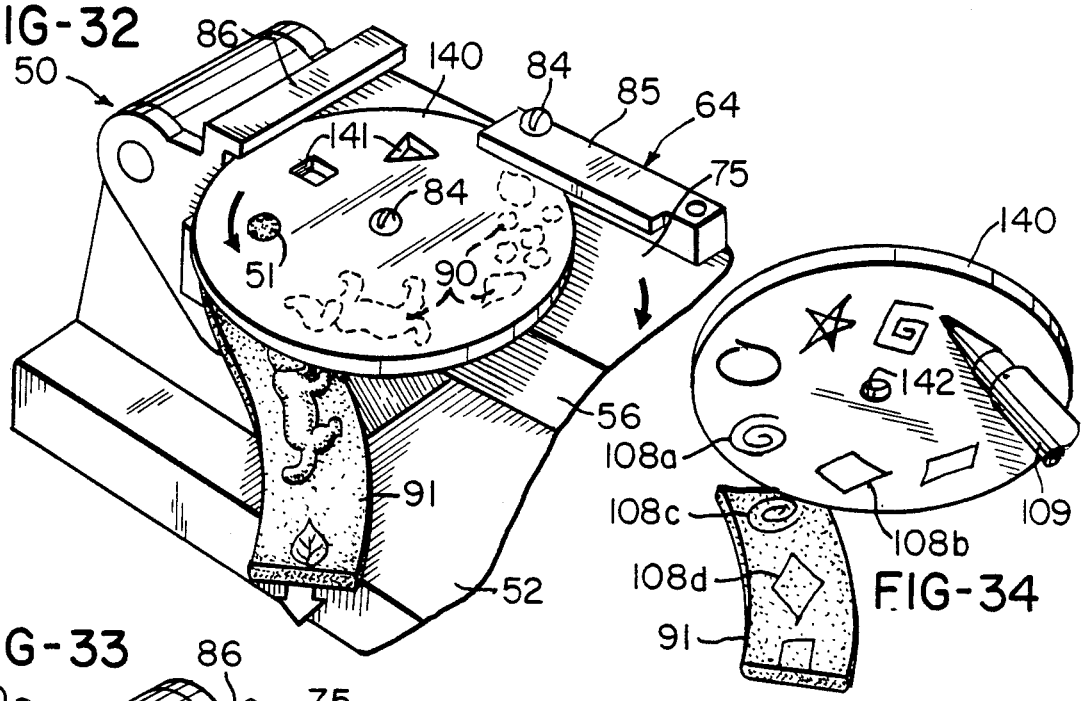
FIG-34
FIG-33
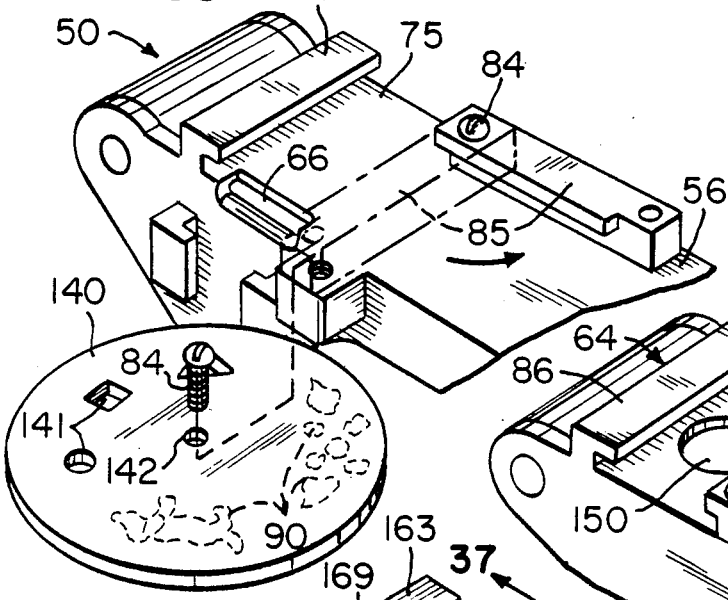
FIG-35
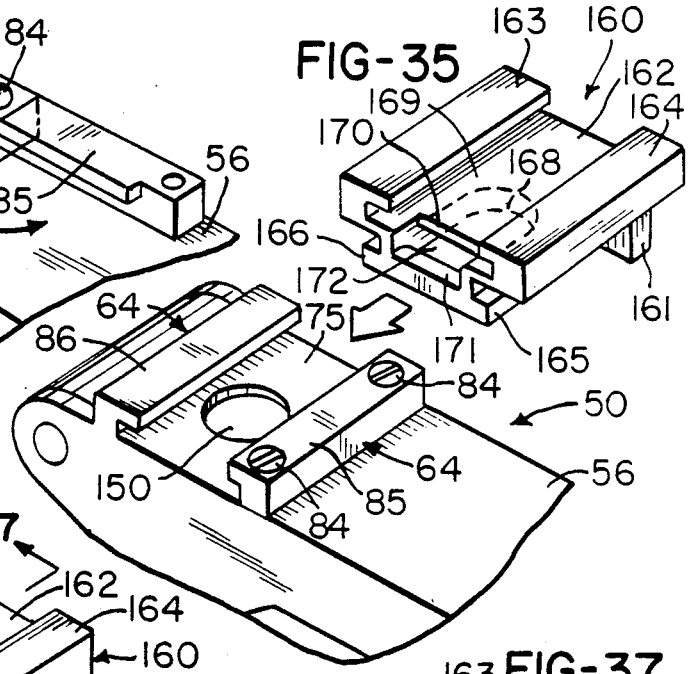
FIG-36
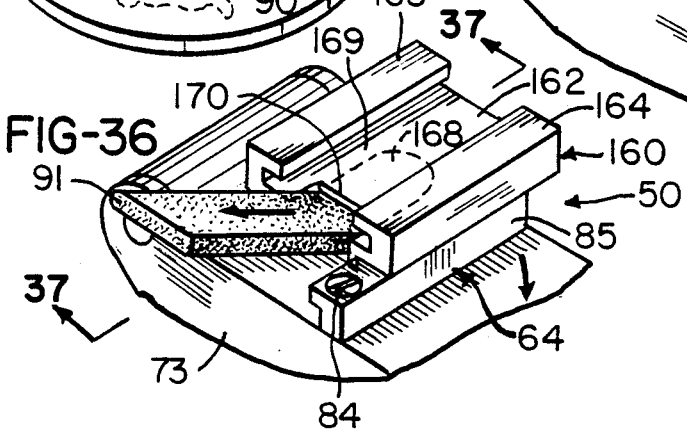
FIG-37
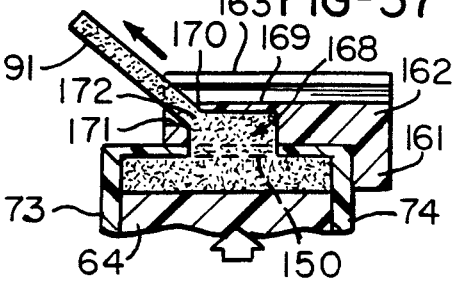

METHOD AND DEVICE FOR SIMULTANEOUSLY PROPELLING AND FORMING IMPRESSIONS WITH A FLOWABLE MATERIAL

BACKGROUND OF THE INVENTION

1. Field of the Invention

The present invention relates to a toy having a means for receiving operatively connected thereto which simultaneously propels and forms impressions in a flowable material.

2. Description of the Prior Art

It is well known in the Prior Art to use modeling compound or other similar materials to extrude a plurality of differently configured cross-sectional configurations with modeling compound. As disclosed in U.S. Pat. No. 3,264,684 (Boggild et al), a toy extruder consisting of a flat elongated base, side walls projecting intregally up from the base and spaced inwardly from the side edges of the base, a pair of spaced arcuate walls located between the side walls and form with these walls an arcuate chamber in the base having a supply opening, a discharge opening, an operating lever, an arcuate piston, a slide holder at the discharge holder end of the chamber, a slide plate mounted in the holder, this slide plate having a plurality of different configurated openings and at least one upwardly projecting post on each side edge of the base spaced from each respective side wall to form a storage area for receiving the slide plate, is illustrated.

While this prior art device greatly increased the joy of playing with modeling compound for the more imaginative children, it only expanded the possibilities one additional dimension, that being the extrusion of the modeling compound.

In contrast, the present invention greatly increases the number of operations which the more imaginative children are able to accomplish while playing with modeling compound. While retaining the ability to create a wide variety of unusual designs through extrusion, the present invention allows the children to learn mechanical principles, to learn word association with pictures, to piece together parts of a puzzle, to learn color transfer, spelling and numbers as well as allowing the child to start with a basic device for accomplishing the simultaneously propelling and forming impressions with a means for receiving and thereafter adding accessories requiring a higher level of skill for their operation. As the children develop their ability to create a wide variety of designs and combinations through the stimulation of their imaginations by the addition of components to the device to create additional designs in a variety of ways, the children's joy of playing with modeling compound is greatly increased over that by that attained by the prior art device.

In addition to the above stated advantages of the stated invention, applicants find that use of a flowable material to power toys is new. Presently, most toys are powered by springs, batteries, etc. The present invention provides the ability for use of the flowable material to give animation to a toy. Thus, the interest of the more imaginative children is retained due to the visibility of the motion created by the power provided by the flowable material.

SUMMARY OF THE INVENTION

The present invention relates to a device for simultaneously propelling and forming impressions in a flowable material with a means for receiving.

One embodiment of the present invention consists of means for supporting the device, lever means, piston means, means for pivoting lever means about the piston means, means for storing flowable material, means for receiving flowable material, means for guiding the means for receiving and means for transferring the flowable material from the means for storing to the means for receiving which is operatively connected to the present invention.

Accordingly, it is an object to the present invention to provide a device for simultaneously propelling and forming impressions in a flowable material with means for receiving.

It is another object of the present invention to provide a device having a means for receiving operatively connected thereto in a compact convenient form for use by children and others with which flowable material may be molded into constructive objects with decorative shapes.

It is yet another object of the present invention to provide a device which the more imaginative children can use it to increase their verbal skills.

It is still another object of the present invention to provide a device which the more imaginative children can use to develop their puzzle solving ability.

It is yet a further object of the present invention to provide a device with which the more imaginative children can learn various mechanical principles.

It is a further object of the present invention to provide a device for use by children and others for forming objects in flowable materials such as impressions of the alphabet and numerals.

It is yet another object of the present invention to provide a device which will power and give animation to the toys using flowable material as the power source.

It is still another object of the present invention to provide a device which imparts movement to the various means for receiving when flowable material exits the nozzle at an angle between 0° and 90°.

It is still a further object of the present invention to provide a device which can be used to stimulate the imagination of less imaginative children so that they receive the benefits mentioned previously.

Further objects and advantages of the present invention will become apparent from the following description of the preferred embodiment, the claims and the attached drawings.

BRIEF DESCRIPTION OF THE DRAWINGS

In the following detailed description of the preferred embodiment of the present invention, reference is made to the accompanying drawings, in which:

FIG. 1 is a perspective view of the preferred embodiment.

FIG. 2 is a perspective view illustrating the operation of the preferred embodiment of FIG. 1 after compression of flowable material in the cavity.

FIG. 3 is a fragmentary view illustrating the detail of both the means for guiding and nozzle means of the preferred embodiment of FIG. 1.

FIG. 3A is a top fragmentary view of the nozzle means of FIG. 3 taken along line 3—3.

FIG. 4 is a fragmentary view further illustrating the operating positions of the preferred embodiment of FIG. 1.

FIG. 5 is a section taken along line 5—5 of FIG. 4.

FIG. 6 is a fragmentary perspective view illustrating the operation of the nozzle means.

FIG. 32 is a fragmentary perspective view of the preferred embodiment of FIG. 1 with a rotary disk attached.

FIG. 33 is a fragmentary perspective view illustrating the nozzle means and the attachment means for the rotary disk in FIG. 32.

FIG. 34 is a perspective view of the rotary disk of FIGS. 32 and 33 illustrating color transfer from the rotary disk to the flowable material.

FIG. 35 is a fragmentary perspective view of an extruder and an attachment which converts the extruder into a device which functions as the preferred embodiment of FIG. 1.

FIG. 36 is a a partial fragmentary perspective view of the conversion device of FIG. 35 attached to the extruder of FIG. 35.

FIG. 37 is a section taken along line 37—37 of FIG. 36.

DETAILED DESCRIPTION OF THE PREFERRED EMBODIMENT

Figure 7:
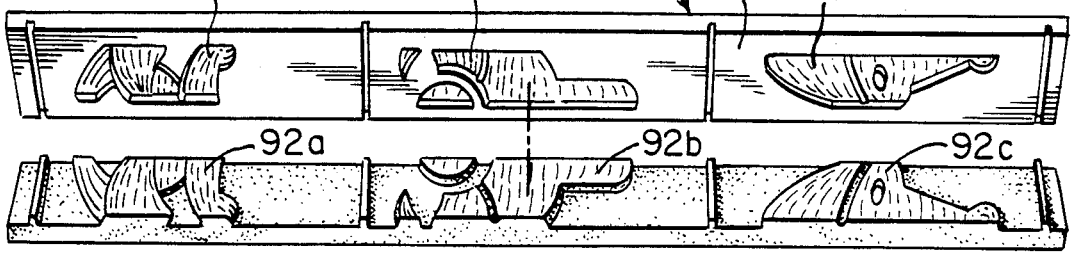
FIG. 7 is an example of a receiving means consisting of a three cavity strip forming a single image.

The following description will be directed in particular to elements performing part of or cooperating more directly with the present invention. Elements not specifically shown or described herein are understood as selected from those known in the art.

Referring now to the drawings and specifically to FIGS. 1–6, one embodiment of an apparatus for simultaneously propelling and forming impressions with a flowable material or device according to the present invention, generally designated 50, is illustrated. Device 50 consists of the following major elements means for supporting 52, piston means 54, lever means 56, means for pivoting 58, means for storing 60, means for receiving 62, means for guiding 64, and means for transferring or nozzle means 66.

Device 50 consists of means for supporting 52 operatively connected to piston means 54. Means are provided for pivoting lever means 56 about piston means 54. In the embodiment illustrated in FIGS. 1–6, means for pivoting 58 consists of means for connecting or pin 69 operatively connecting lever means 56 to piston means 54. In order to connect lever means 56 to piston means 54, pin 69 is inserted in sequence through bore 70 of lever 56, chamber 71, and bore 68 of leverl means 56. Pin 69 is retained in position by retaining means or lugs 72 or other appropriate retaining means. Although pin 69 and retaining lugs 72 are illustrated, it is possible to pivotally mount lever means 56 to piston means 54 by other suitable methods, an example of which is using protrusions formed integral with lever means 56 which then lock into position in bores 68 and 70 or other suitable structures.

Means are provided for storing a flowable compound in lever means 56. In the embodiment illustrated in FIGS. 1–6, this consists of a means for storing 60. As best illustrated in FIGS. 4 and 5, means for storing 60 is formed by four walls 73, 74, 75 and 76. Left wall 73 and right wall 74 when operatively connected to lever means 56 additionally serve as side walls of lever means 56. Top wall 75 is also operatively connected to lever means 56 and also serves as the surface in sliding contact with means for receiving 62 as means for receiving 62 is propelled across device 50 during operation of device 50. Back wall 76 consists of an arcuate surface along which piston means 54 slides smoothly yet restrains flowable material 51 from exiting means for storing 60 around piston means 54 as lever means 56 is pivoted toward means for supporting 52. The definition of means for storing 60 is completed with the merger of top wall 75, side walls 73, 74 in the vicinity of means for pivoting 58.

Means are provided for transferring flowable material 51 from means for storing 60 to means for receiving 62. In the embodiment illustrated in FIGS. 1–6, this consists of means for transferring 66 preferrably formed at the junction of top wall 75 and side walls 73 or 74. Referring to FIGS. 3–6, and FIG. 3*a* in particular, means for transferring or nozzle means 66 is illustrated in detail. Nozzle means 66 consists of notch 81 cut in top wall 75 and notch 82 in side wall 73 where topwall 75 and side wall 73 merge. Preferrably notches 81 and 82 are cut between and symmetrical to members 85 and 86 of means for guiding 64. Internal edge 87 of notch 82 in wall 73 is formed such that the existing flowable material 51 is unabraded. This may mean that edge 87 of notch 82 in wall 73 is lower than external edge 88 of wall 73 or that edge 87 is rounded off or any similar structure achieving the same result. As best illustrated in FIGS. 3*a* & 4 when viewed from above, it is important to the present invention that notch 81 of top wall 75 be located such that gap 83 exist between wall 75 and internal edge 87 of wall 73. Additionally when viewed from the side, it is important that gap 83*a* exist between notch 81 of wall 75 and notch 82 of wall 73.

It appears that means for transferring 66 is best located proximate to an edge of device 50. More specifically, preferrably near the junction of side walls 73 or 74 and topwall 75. As illustrated in FIG. 3, the position of means for transferring 66 minimizes the drag of the flowable material and prevents the flowable material from hanging up or locking up between means for transferring 66 and means for receiving 62.

Means are provided for receiving flowable material 51 upon exiting means for storing 60 through means for transferring 66. In the embodiment illustrated by FIGS. 7–18, this consists of means for receiving or member 62. Bottom surface 63 of member 62 may contain at least one cavity 90, be flat, contain protrusions, geometrical designs and patterns, numbers or any combination thereof. Both surfaces of member 62 may contain cavities 90, cavity 90 can be shaped as letters of the alphabet, animals, parts of animals, humanlike figures, part of humanlike figures, words, or any other conceivable shape. As illustrated in FIGS. 1–2, member 62 is designed so that it is freely slidably mounted between members 85 and 86 of means for guiding 64 (as shown in FIG. 6). While a thin square or rectangular member 62 is illustrated in FIGS. 7–18, other means for receiving 62 such as a rotary disk and circular member will be discussed later.

Means are provided for guiding means for receiving or member 62 above means for transferring or nozzle means 66 so that flowable material 51 contacts and/or adheres to surface 63 of member 62 during operation of device 50. In the embodiment illustrated in FIGS. 1–6, means for guiding 64 consists of two parallel members 85, 86 operatively connected to top wall 75. Members 85 and 86 are parallel and spaced apart approximately the width of member 62. Member 85 is detachably mounted on top wall 75 such that a rotary disk can also be operatively connected to device 50.

To prepare the device 50 for operation, lever means 56 is rotated away from means for supporting 52 so that a quantity of flowable material 51 can be placed either on piston 54 or in means for storing 60 defined by walls 73, 74, and 75 in lever means 56 and means for pivoting 58. After the positioning of flowable material 51, means for receiving 62 is inserted into means for guiding 64 such that the forward edge of means for receiving 62 is flush with the front portion of means for guiding 64 directly above means for transferring 66. As illustrated in FIG. 4, once means for receiving 62 is in position, lever means 56 is urged from its upper position toward means for supporting 52. As lever means 56 moves toward means for supporting 52, flowable material 51 is compressed in means for storing 60 by piston means 54 and thus forced toward means for transferring 66. As flowable material 51 exits nozzle 66 at an angle greater than 0° but less than 90° relative to top wall 75 and/or means for receiving 62, contact is made between flowable material 51 and the leading edge of surface 63 of means for receiving 62. As more flowable material 51 is forced out of means for transferring 66 by the continuous urging of lever means 56 toward means for supporting 52, flowable material 51 simultaneously contacts and propels means for receiving 62 in the same direction as the acute angle of exit of flowable material from means for transferring 66 (see FIG. 6 for the angle of exit). As flowable material 51 is forced from means for transferring 66, the leading edge of means for receiving 62 is propelled away from the exit point of means for transferring 66 via means for guiding 64. As the means for receiving 62 moves, flowable material 51 may contact cavity 90, a void, a smooth surface, a geometrical design or pattern or a protrusion in means for receiving 62. When means for receiving 62 has been completely propelled across means for guiding 64, a thin strip of flowable material 51 may, but not necessarily, adhere to bottom surface 63 of means for receiving 62. If the thin strip of flowable material does adhere to surface 63 of member 62, it must be separated from means of receiving 62 by first severing flowable material near the exit point of means for transferring 66. Once flowable material 51, if adhering thereto, has been separated from means for receiving 62, the surface of flowable material 51 which may be adhering to bottom surface 63 of means for receiving 62 is peeled away, revealing impressions in surface 91 of the strip of flowable material which was in contact with the cavity 90, smooth surface, geometrical designs protrustions or voids in means for receiving 62. At this point it should be pointed out that it is only necessary that flowable material 51 make contact with means for receiving 62 near means for transferring 66. As discussed above, in order for device 50 to function properly, it is not necessary that flowable material 51 adhere to means for receiving 62, it is only necessary that flowable material 51 contact means for receiving 62 long enough for means for receiving 62 to be propelled across means for transferring 66. While flowable material 51 may adhere to means for receiving 62, if a smooth means of receiving 62 is used for color transfer, flowable material 51 may not adhere to surface 63 of means for receiving 62 and will simply fall by force of gravity to the surface supporting device 50.

As illustrated in FIGS. 7–15, the following is a detailed description of the illustrated embodiment of the means for receiving or strip 62*a*. Means for receiving 62 may have at least one but preferably more cavities 90 formed in at least one surface 63 of strip 62*a*. It should be understood that means for receiving 62 may have cavity 90 formed on its other surfaces. However, it is preferred that at most two surfaces will contain cavity 90 or other designs. Once strip 62*a* has been propelled across means for transferring 66 thereby being contacted by flowable material 51 exiting means for transferring 66 on bottom surface 63 of strip 62*a*, a thin strip of flowable material 91 is formed, containing protrusion 92 corresponding to cavity 90.

Figure 8:
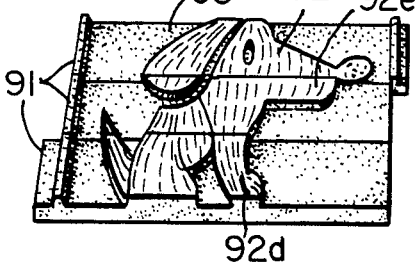
FIG. 8 illustrates the assembled sections of a strip of flowable material formed by the three cavity strip in FIG. 7 forming a single image.
Figure 9:
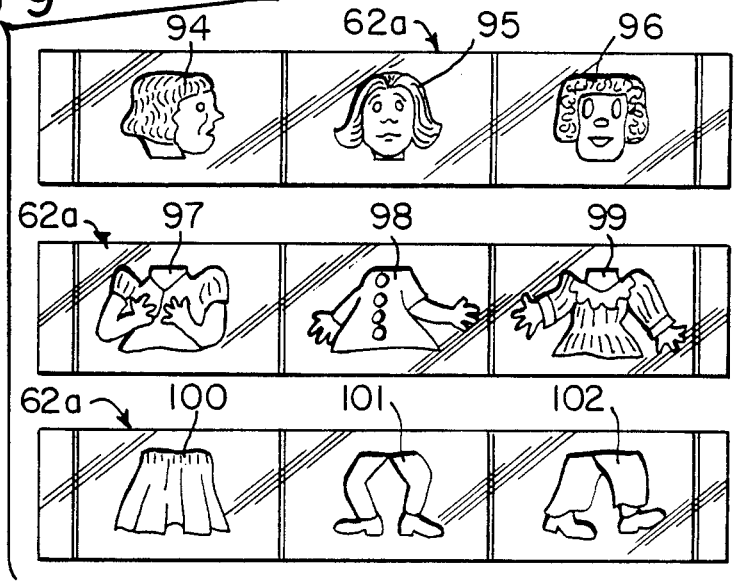
FIG. 9 illustrates receiving means consisting of three separate strips with multiple cavities.
Figure 10:
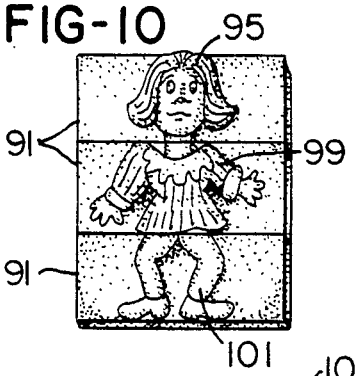
FIG. 10 is an example of a composite image assembled from at least one cavity of each strip in FIG. 9.

As illustrated by FIG. 8, one single strip 62*a* is capable of providing a plurality of components to form a larger figure such as dog 93 of FIG. 8. As illustrated by FIGS. 9 and 10, strip 62*a* can contain several cavities 90 in the forms of various parts of the human body such as heads, 94, 95, 96, abdomens, 97, 98, 99, and legs, 100, 101, 102. While not specifically illustrated, it should be understood that it is possible to form different components on both surfaces of strip 62*a*. While only two surfaces are preferred, it is possible to use a triangle shaped or an elongated cube shaped strip 62*a*. As illustrated in FIG. 10, the various body parts can then be arranged to form a particular figure. The girl of FIG. 10 is composed of head 95, abdomen 99 and legs 101 selected from the three components of each separate strip 62 of FIG. 9. Obviously a plurality of different arrangements is possible for presenting a variety of figures such as people, animals, words etc. Additionally, it is possible to assemble words formed by selecting appropriate letters formed by cavities 90 protrusions or voids in strip 62*a* and thereafter arranging the letters in the proper order.

Figure 11:
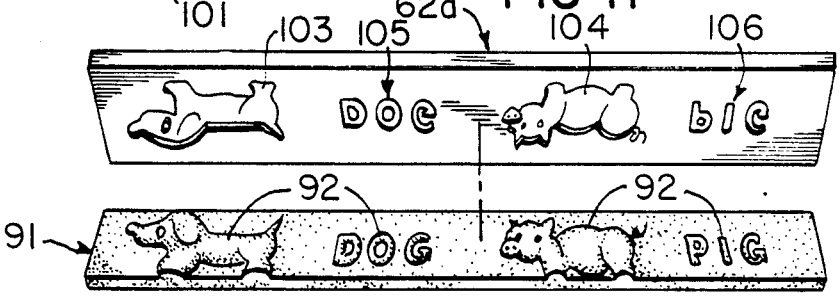
FIG. 11 illustrates receiving means consisting of a single strip containing cavities forming both illustrations and words.

As illustrated by FIG. 11, it is possible to form cavities depicting both animals and words in the same strip 62*a*. Strip 62*a* contains cavities 90 in the form of dog 103 and pig 104 followed by word descriptions of dog 105 and pig 106, respectively. Images 103 and 104 and word descriptions 105 and 106 may be formed on a plurality of means for receiving 62 either in proper sequence or randomly scrambled. Means for receiving 62, with the proper order of image and word description, could be utilized to teach children to associate the image dog with the word dog, etc. Randomly scrambled images and word descriptions on means for receiving 62 could be utilized by children as a game in which they match the proper word description with the proper image selected from a number of images and words. While means for receiving 62 illustrated in FIG. 11 contains a dog and pig, it is understood that the possibility of image/word associations are limitless. Further, in addition to cavities, voids and protrusions may be utilized on the surface of strip 62*a* to achieve the same image/word association.

Figure 12:
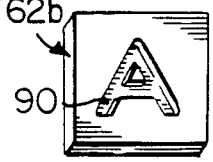
FIG. 12, is an example of a receiving means consisting of a square strip.
Figure 13:
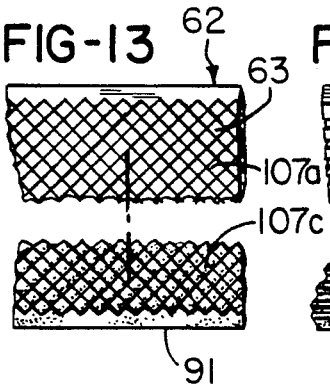
FIG. 13 illustrates receiving means having a geometrical design on one surface.
Figure 14:
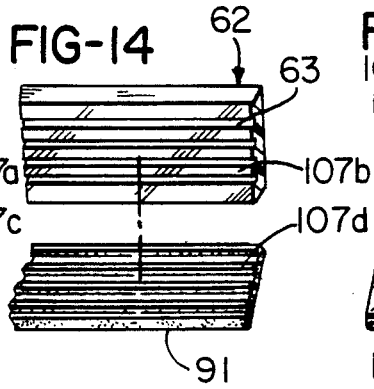
FIG. 14 illustrates receiving means having a pattern on one surface.

As illustrated in FIG. 12, square means for receiving 62*b* can also be utilized in device 50. Like rectangular strip 62*a*, square strip 62*b* can have cavities, protrusions, smooth surfaces, or geometrical patterns or designs or voids on all surfaces.

As illustrated in FIGS. 7–11, it should be pointed out that strip 62*a* of FIGS. 7–11 is preferred over strip 62*b* of FIG. 12, since means for storing 60 can hold sufficient flowable material 51 to propell the illustrated long rectangular thin strip 62*a* of FIGS. 7–11 across its entire length. Since children can simultaneously see the motion of strip 62*a* and the formation of a plurality of impressions during one continuous operation of device 50, the rectangular shape appears to be the most interesting to children.

Means are provided for forming geometrical design 107 in flowable material 51. In the embodiment of means for receiving 62 illustrated by FIGS. 13–14, this consists of etching or otherwise forming the desired design on the bottom surface 63 of means for receiving 62. While only two specific designs 107*a* and 107*b* are illustrated, it is understood that numerous, if not all, possible designs could be etched, molded or formed on bottom surface 63 or on both surfaces of means for receiving 62 by conventional methods and thus transferred to strip of flowable material 91 during operation of device 50.

Figure 15:
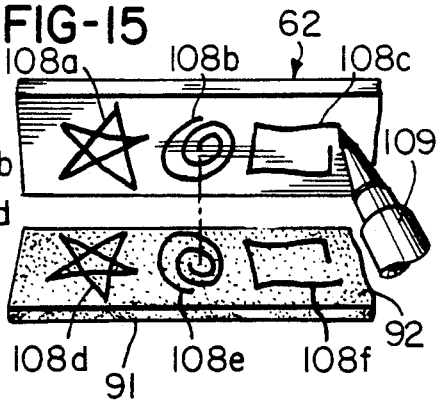
FIG. 15 illustrates receiving means for transferring color images from one surface of the receiving means onto the flowable material.

Means are provided for transferring hand drawn color designs from means for receiving 62 to thin strip of flowable material 91. In the embodiment illustrated in FIG. 15, this is accomplished by drawing designs 108*a*, 108*b*, 108*c* on one surface of means for receiving 62. As means for receiving 62 is propelled across means for transferring 66, flowable material 51 contacts one surface of means for receiving 62, the impressions of designs 108*a*, 108*b* and 108*c* are transferred as mirror images 108*d*, 108*e* and 108*f* in the same color as drawn on the surface 62 to upper surface 92 of strip of flowable material 91. As illustrated in FIG. 15, this is accomplished by drawing designs 108*a*, 108*b* and 108*c* on one surface of means for receiving 62 with color pen 109. It is understood that most commercially available color water soluble type felt tip pens will suffice for this operation. Since the designs 108*a*, 108*b* and 108*c* are transferred as mirror images 108*d*, 108*e* and 108*f*, writing or lettering on the appropriate surface will appear as mirror images on surface 92 of strip of flowable material 91.

Figures 16, 17, 18, 19, 20, 21, 21A, 22, 23, 24:
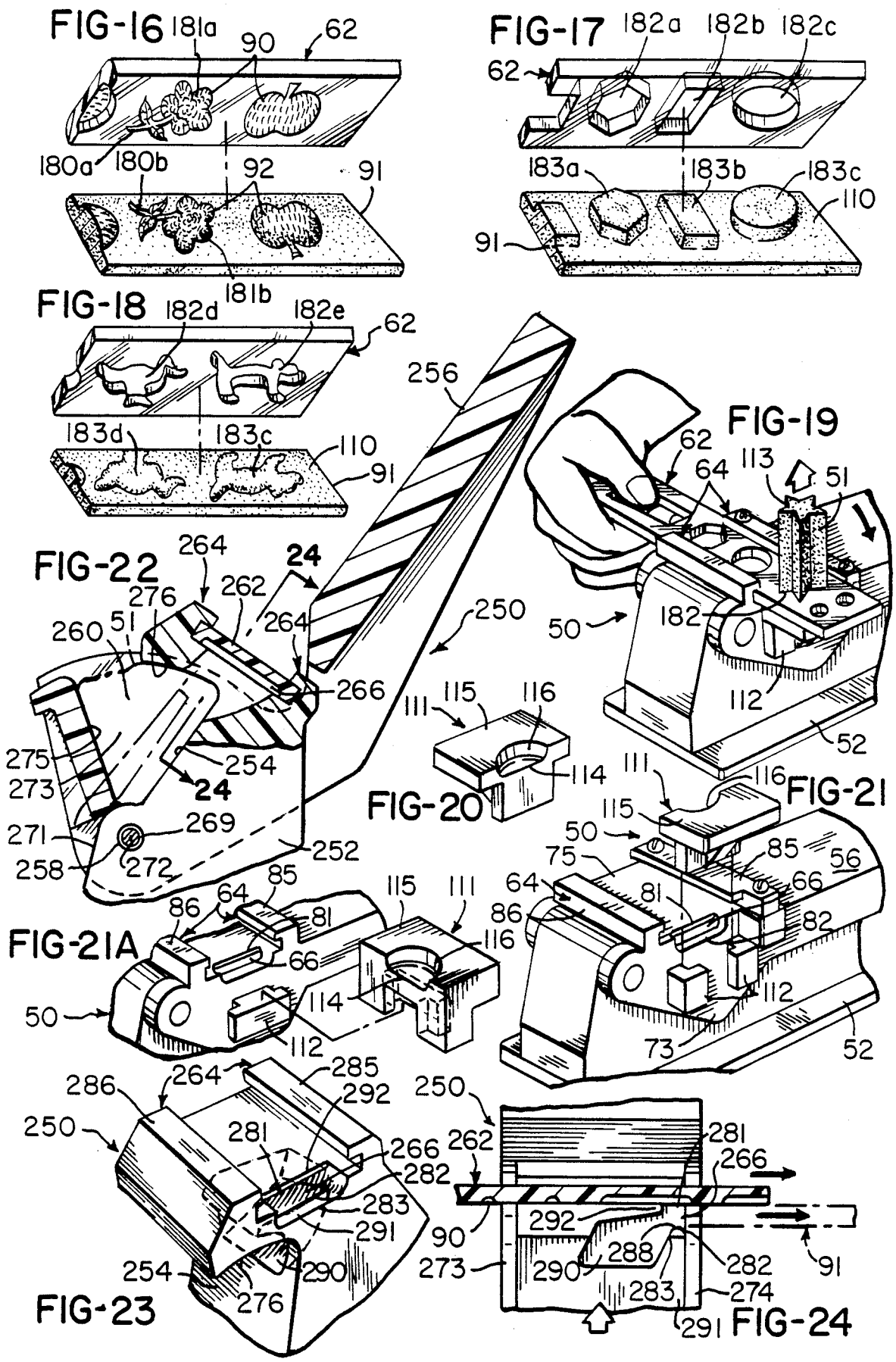
FIG. 16 illustrates receiving means having cavities and transferring color from the cavities onto the flowable material.
FIG. 17 illustrates receiving means having apertures or voids.
FIG. 18 illustrates receiving means having apertures in the shape of animals.
FIG. 19 illustrates the the preferred embodiment of FIG. 1 converted to extrude flowable material.
FIG. 20 illustrates the attachment device for converting the preferred embodiment of FIG. 1 into an extruder.
FIG. 21 illustrates the attachment of the extruder converter to the preferred embodiment of FIG. 1.
FIG 21*a* illustrates an alternate attachment of the extruder converter to the preferred embodiment of FIG. 1.
FIG. 22 illustrates an alternate embodiment of the device of FIG. 1.
FIG. 23 is a fragmentary perspective view of both the means for guiding and nozzle means of FIG. 22.
FIG. 24 is a section taken along line 24—24 of FIG. 22.

Color transfer can also be accomplished by marking cavity 90 of FIG. 16 with color pen 109 so that image 92 on strip of flowable material 91 appears to be the same color as that portion of cavity 90 which was colored by pen 109. For example, in FIG. 16 stem 180*a* could be colored green and flower 181*a* red. After being propelled through device 50, the corresponding images 180*b* and 181*b* formed on strip of flowable material 91 have the same green color for stem 180*b* and red for flower portion 181*b* as originally drawn.

Finally, with respect to means for receiving 62 illustrated in FIGS. 17–18, it is possible to cut designs completely through means for receiving 62 such that apertures, voids or orifices 182*a*, 182*b*, 182*c*, 182*d* and 182*e* are formed in means for receiving 62. During normal operation of device 50, flowable material 51 will fill voids 182*a*, 182*b*, 182*c*, 182*d*, and 182*e* to form corresponding protrusions 183*a*, 183*b*, 183*c*, 183*d* and 183*e*. It should be noted that impressions formed by voids 182 may protrude higher above surface 110 of strip of flowable material 91 than those formed by cavity 90.

Referring now to the drawing and specifically to FIGS. 22–24 an alternate embodiment of an apparatus for simultaneously propelling and forming impressions in a flowable material with a means for receiving or a device, according to the present invention, generally designated 250 is illustrated. As does device 50, alternate device 250 consists of the following major elements, means for supporting 252, piston means 254, lever means 256, means for pivoting 258, means for storing 260, means for receiving 262, means for guiding 264 and means for transferring 266.

Device 250 consists of means for supporting 252 operatively connected to supporting piston means 254. Means are provided for pivoting lever means 256 about piston means 254. In the embodiment illustrated in FIGS. 22–24, means for pivoting 258 consists of means for connecting or pin 269 operatively connecting lever means 256 to piston means 254. In order to connect lever means 256 to piston means 254, pin 269 is inserted in sequence through bore 258, chamber 271 (not shown) and bore 270 (not shown) in lever means 256. Pin 269 is retained in position by retaining lugs 272 or other appropriate retaining means. Although the corresponding pin 269 and retaining lug 272 of device 50 are illustrated (see FIGS. 1–6), as with device 50 it is possible to pivotly mount lever means 256 to piston means 254 by other suitable methods, an example of which is using protrusions formed integral with lever means 256 which then lock into position in bores 268 and 270 or other suitable structures.

Means are provided for storing flowable compound 51 in lever means 256. In the embodiment illustrated in FIGS. 22–24, this consists of means for storing 260. As best illustrated in FIG. 22, means for storing 260 is formed by three walls of lever means 256, left wall 273, right wall 274 (not shown) and front wall 275. Top wall 276, as illustrated in FIG. 23, consists of a flange like extension of piston means 254. Top wall 276 consists of an arcuate surface along which the upper portion of front wall 275 slides smoothly yet restrains flowable material 51 from exiting means for storing 260 around top wall 276 as lever means 256 is pivoted toward means for supporting 252. The boundaries of means for storing 260 consist of side walls 273, and 274, front wall 276, back wall or piston means 254, and top wall 276. Means for storing 260 is completed with merger of side walls 273 and 274 with front wall 275 and piston means 254 at means for pivoting 258. The merger at means for pivoting 258 of the above mentioned walls forms V-shaped means for storing 260.

Means are provided for transferring flowable material 51 from means for storing 260 to means for receiving 262 corresponding to means for receiving 62 of FIGS. 1–6. In the embodiment illustrated in FIGS. 22–24, this consist of means for transferring or nozzle means 266 formed at the junction of top wall 276 and piston means 254. Referring to FIGS. 23 and 24 specifically, means for transferring or nozzle means 266 is illustrated in detail. Means for transferring 266 consists of bore 290 at the junction of piston means 254 and top wall 276. Bore 290 is located at the junction of arcuate top wall 276 and piston means 254. Bore 290 which connects piston means 254 to top wall 292 and side wall 291 terminating in notch 281 in top wall 292 and notch 282 in side wall 291 of piston means 254.

Means are provided so that bore 290 can transfer flowable material 51 from means for storing 260 to means for receiving 62 via means for transferring 266. In the embodiment illustrated in FIGS. 23 and 24, as mentioned above, means for transferring 266 consist of notch 281 in top wall 292 and notch 282 in side wall 291. Both notches 281 and 282 preferably merge with bore 290 such that they are located between two symetrical members 285 and 286 of means of guiding 264. When viewed from above, internal edge 283 of notch 282 is formed such that the exiting flowable material 51 is unabraded. This may mean that internal edge 283 of notch 282 is rounded and smooth or lower than external edge 288 of wall 291 or any similar structure achieving the same result.

Experience indicates that nozzle 266 is best located proximate to one edge of device 250. More specifically, preferrably near the junction of walls 291 or 293 and top wall 292. As illustrated in FIG. 23, the position of means for transferring 266 minimizes the drag of the flowable material and prevents the flowable material from hanging up or locking up between nozzle 266 and means for receiving 262.

As previously described for device 50, means are provided for receiving flowable material 51 upon exiting means for storing 260 through nozzle 266. In the embodiment illustrated in FIGS. 22–24, this consist of means for receiving or strip 262 corresponding directly to means of receiving 62. Bottom surface 263 of means for receiving 262 may contain at least one cavity 90 protrusion, void, geometrical design or may be smooth. As previously described, cavity 90, protrusion or void may be shaped as letters of the alphabet, animals, numerals, parts of words, any conceivable geometrical designs/patterns. Means for receiving 262 may also have a smooth surface. As illustrated in FIGS. 22 and 24, strip 262 is designed so that it is freely slideably mountable between members 284 and 285 of means for guiding 264.

As mentioned above, and as illustrated in FIGS. 22–24, means are provided for guiding means for receiving or strip 262 above means for transferring 266 so that flowable material 51 contacts and/or adheres to surface 263, means for guiding 264 consists of two parallel members 285 and 286 operatively connected or intregral with top wall 292. Members 285 and 286 are parallel and spaced apart approximately the width of means for receiving 262. At this point it should be understood that there are ways of connecting means for guiding 264 to top wall 292 other than that which is illustrated. Member 285, while not shown as detachably mounted on top wall 292, may be detachably mounted such that other means for receiving 262 or rotary member can be operatively connected to device 250.

Alternate device 250 can perform all operations performed by device 50. All means for receiving described and illustrated as being operable with device 50 are also operable with device 250. The major difference in construction between the two devices being that the means for guiding 264 of device 250 is integral with or attached to piston means 254 rather than being attached to lever means 56 as in device 50. The result of this arrangement is that means for guiding 264 and means for transferring 266 remain stationary during operation of lever means 256. Additionally in contrast to means for transferring 66 of device 50, means for transferring 266 of device 250 is located in piston means 254 rather than in the lever means 56.

To prepare device 250 for operation, lever means 256 is rotated away from means for supporting 252 so that a quantity of flowable material 51 can be placed in means for storing 260 defined by walls 273, 274, 275 and 276. After flowable material 51 is so positioned, means for receiving 262 may be inserted into means for guiding 264 such that the forward edge of means for receiving 262 is flush against the front of means for guiding 264 directly above nozzle 266. As illustrated in FIG. 22, once means for receiving 262 is in position, lever means 256 is urged from its upper position toward means for supporting 252, flowable material 51 is compressed in means for storing 260 by piston means 254. Flowable material 51 is thus forced towards means for transferring 266. As flowable material 51 exits means for transferring 266 at an angle greater than 0° but less than 90° relative the plane of top wall of piston means 254 and/or the means for receiving 262 contact is made between flowable material 51 and the leading bottom surface 263 of edge of means for receiving 262. As more flowable material 51 is forced out of means for transferring 266 by the continuous urging of lever means 256 toward means for supporting 252, flowable material 51 simultaneously contacts and propels means for receiving 262 in the direction of the acute angle formed by the exit of flowable material 51 from means for transferring 266 and top wall 292. As flowable material 51 is forced from means for transferring 266, the leading edge of means for receiving 262 is propelled away from the exit point of nozzle 266 via means for guiding 264. As the means for receiving 262 moves, flowable material contacts cavities 90 protrusions, voids, etc. contained in means for receiving 262. When means for receiving 262 has been completely propelled across means for transferring 266, a thin strip of flowable material may, but not necessarily, adhere to bottom surface 263 of means for receiving 262. From this point forward, as indicated above, alternate device 250 operates in the same manner as device 50.

Referring now to FIGS. 19–21*a*, means are provided for converting device 50 into an extruder. As illustrated in FIGS. 19–21*a*, this consists of extrusion attachment means 111 and means for positioning extrusion attachment 112. Extrusion attachment means 111 is located proximate to means for transferring 66 such that flowable material 51 exiting means for transferring 66 between notch 81 in upper wall 75 and notch 82 in side wall 73 is directed upward at an angle of almost exactly 90°. Means for receiving 62, such as the embodiment illustrated by FIGS. 17 and 18, is positioned, as illustrated, in FIG. 19, such that an elongated strip of flowable material 113 is produced. Extrusion attachment means 111, preferrably consisting of a block of material friction fitted or snapped into place on the side of device 50, is adapted to cooperate with means for transferring 66 such that edge 114 of means 111 aligns with edge 88 of notch 82 when means 111 is secured by friction or otherwise retained in means for positioning 112. As flowable material 51 exits means for transferring 66, it contacts means 111 at edge 114 and flows into cup like void 116. The direction of flowable material 51 is changed in void 116 from an angle between 0° and 90° relative top wall 75 to approximately perpendicular top wall 75 and flows into void 182 of means for receiving 62 selectively positioned in means for guiding 64 above 111.

Figures 25, 26, 27, 28, 29, 30, 31:
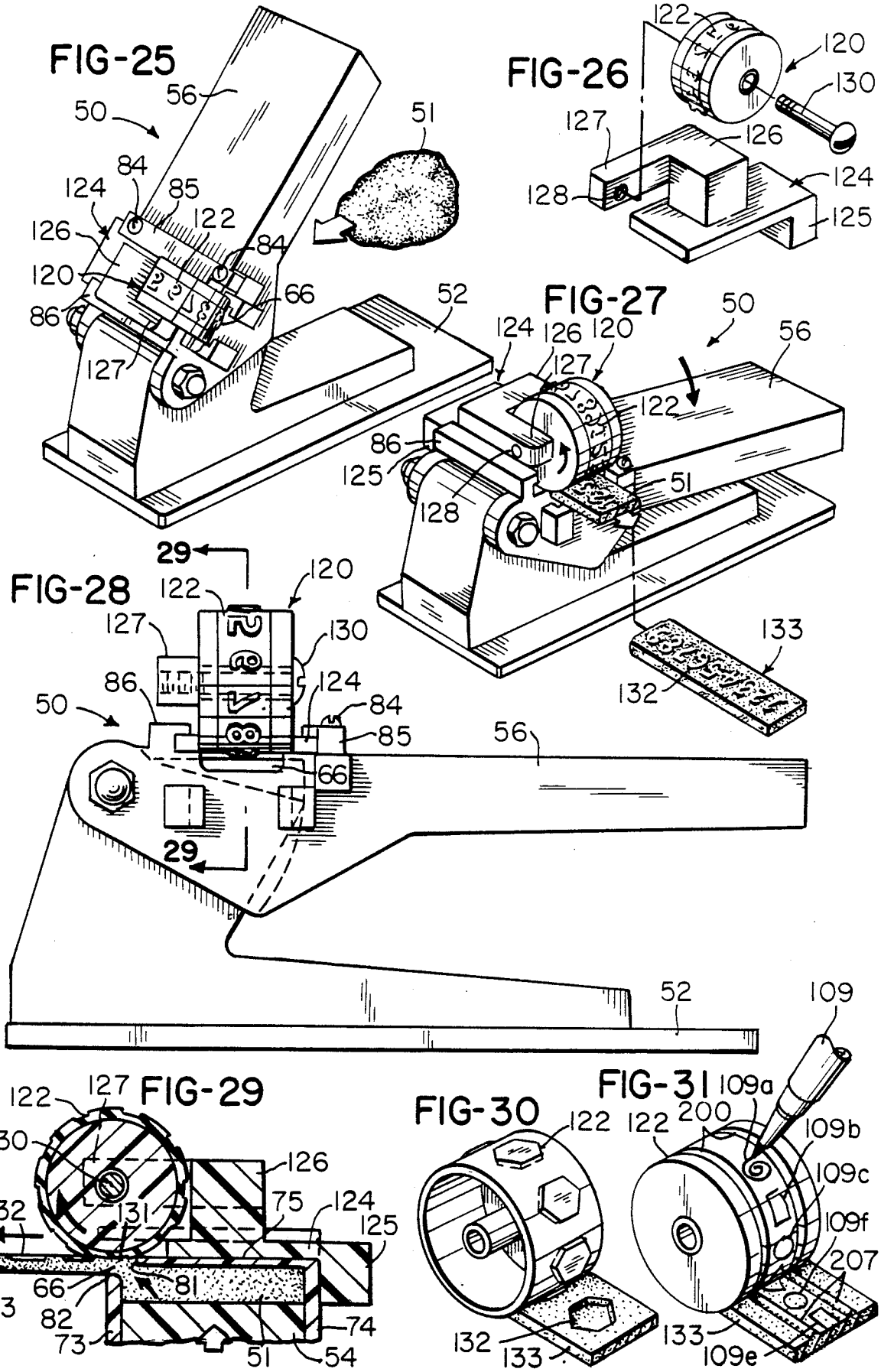
FIG. 25 illustrates the preferred embodiment of FIG. 1 with a circular embosser attached.
FIG. 26 is a detailed perspective view of the circular embosser of FIG. 25.
FIG. 27 illustrates the operation of the preferred embodiment of FIG. 1 with a circular embosser attached.
FIG. 28 is a side view of the preferred embodiment of FIG. 1 with a circular embosser attached.
FIG. 29 is a sectional view taken along the line 29—29 of FIG. 28.
FIG. 30 illustrates alternate protrusions on the surface of the circular embosser of FIG. 26.
FIG. 31 illustrates both patterns on the surface of the circular embosser and color transfer from the embosser of FIG. 26 to the flowable material.
Figure 38:
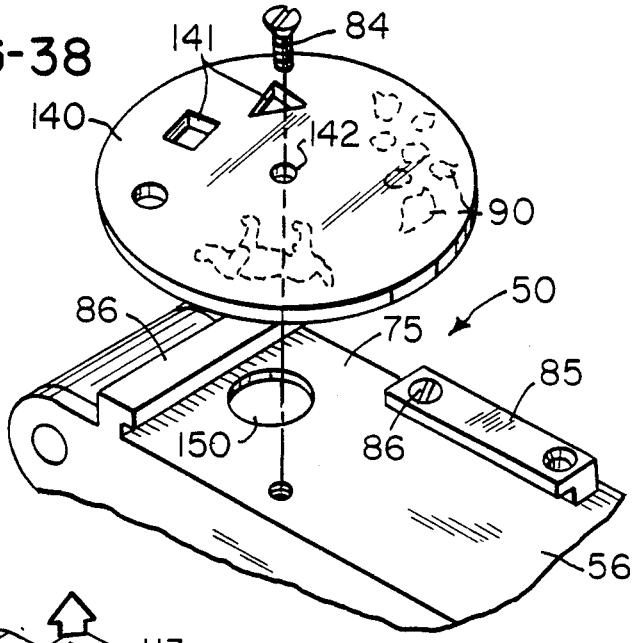
FIG. 38 is a partial fragmentary perspective view of the extruder of FIG. 35 with a rotary disk attached.

While not specifically illustrated in the Figs., it should be pointed out that device 50 modified to extrude flowable material 51 with extrusion attachment means 111 attached thereto by means of positioning 112 can be utilized to operate rotary attachment 120 as illustrated in FIG. 26. As illustrated in FIGS. 26 and 27, rotary attachment 120 with appropriate modification could be operated by the flow of flowable material 51 perpendicular to the plane of top wall 75. Referring now to FIG. 29, if rotary attachment 120 were to be positioned such that the point of contact 131 between flowable material 51 and means for embossing 122 were adjusted by moving means for embossing 122 to the right, as illustrated in FIG. 29, device 50 with extrusion attachment means 111 in place would accomplish the same result as illustrated in FIGS. 27 and 29.

During operation of device 50 modified to extrude flowable material 51, extrusion attachment means 111 is positioned in means for positioning 112. Next, means for receiving 62 is positioned in means for guiding 64 such that void 182 is selectively positioned over extrusion attachment means 111. Flowable material is placed in means for storing 60 or on piston 54 as explained above (see FIG. 4). Flowable material 51 is forced to exit nozzle 66, as previously described, resulting in elongated configuration 113. At this time, it should be pointed out that means for positioning 112 of extrusion attachment means 111 is illustrated as particular embodiments in FIGS. 21 and 21*a* but may be accomplished by many other conventional means. When extrusion attachment means 111 is properly positioned, upper surface 115 of extrusion attachment means 111 is preferrably even with or slightly above the plane of top wall 75 but below the plane of means for guiding 64. Thus, when flowable material 51 contacts edge 114 of means 111, and lower surface 63 of member 62 in turn, flowable material 51 is directed approximately perpendicular to the plane of both top wall 75 and member 62 such that member 62 is locked in position in means for guiding 64 with selected void 182 directly above means for transferring 66. With void 182 in this position, flowable material 51 is forced through void 182 forming elongated strip of flowable material 113.

Referring now to FIGS. 25–31, means are provided for converting device 50 for use as a rotary embosser. As best illustrated in FIG. 26, rotary attachment 120, consists of means for embossing 122, means for attaching 124, means for positioning 126 and means for rotating 130. Rotary attachment 120 has of means for attaching 124 which is adapted to slidably but releasably fit in means for guiding 64. As best illustrated in FIGS. 28 and 29, means for attaching 124 is securely, slidably but releasably positioned in means for receiving 64 such that means for embossing 122 is located just above means for transferring 66 and in the line of the exiting flowable material 51. As best illustrated in FIG. 29, topwall 75 and point of contact 131 between flowable material 51 and means for embossing 122 are positioned such that the flowable material 51 exits means for transferring 66 and contacts means for embossing 122 thereby forming impression 132 in flowable material strip 133.

Referring now to the positioning of rotary attachment 120 on device 50 (FIGS. 27 and 29), means for attaching 124, having flange 125 in contact with side wall 74 and topwall 75, is operatively connected to means for positioning 126. Means for positioning 126 has arm 127 consisting of means for securing 128 and means for rotating 130. Upon being so positioned, rotary attachment 120 is properly positioned in means for guiding 64. In this regard, rotary attachment 120 functions as an alternate means for receiving 62.

As mentioned previously on page 22 with regard to the extrusion attachment means 111, flange 125 which contacts side wall 74 could be adjustable so that point 131 between flowable material 51 and means for embossing 122 is positioned such that flowable material 51 exits means for transferring 66 contacts extrusion attachment means 111 at edge 114 flowing into cup-like 116 having the direction of flowable material 51 changed such that the contact point 131 with means for embossing 122 forms impressions in flowable material strip impression 132 flowable material strip 133.

During operation of device 50 with rotary attachment 120 positioned as previously described, flowable material 51 is loaded in means for storing 60. As illustrated in FIG. 29, rotary attachment 120 is located in means for guiding 64 so that the means for embossing 122 is located above and centered in near proximately to means for transferring 66. As lever means 56 of device 50 is urged toward means for supporting 52, flowable material 51 exiting means for transferring 66 contacts means for embossing 122 at contact point 131. Upon contacting means for embossing 122, at contact point 131, means for embossing 122 is rotated about means of rotating 130 by the force transferred from flowable material 51 exiting means for transferring 66. As best illustrated in FIG. 29, strip of flowable material 133 formed from flowable material 51 exiting means for transferring 66 has impression 132 formed on its surface of strip 133. Strip of flowable material 133, thus produced preferrably falls by force of gravity to the surface supporting device 50.

It should be stressed that the power for rotating means of embossing 122 is provided by the energy of flowable material 51 upon exiting means for transferring 66 acting at contact point 131. If the location of contact point 131 is changed, the width of strip 133 of flowable material 51 may vary accordingly.

As illustrated in FIGS. 30 and 31, it is possible to affix different protrusions 133 and to form various cavities 200 on means of embossing 122 thereby yielding depressions 132 and protrusions 207, respectively, on strip of flowable material 133. Additionally, it is possible to transfer images 109*a*, 109*b*, and 109*c* from means for embossing 122 onto strip of flowable material 133 as mirror images 109*e* and 109*f* on the surface of strip of flowable material 133. Finally, it should be understood that means for embossing 122 can have cavities for producing mix and match association as previously described for the means for receiving of FIGS. 9–19.

It should be noted at this point that the means for embossing 122 is in fact a circular cylinder the lateral surfaces of which are contacted by the flowable material and may contain cavities protrusions or voids as all other means for receiving or any combination thereof. Additionally, the lateral surface of the wheel of the circular member may in fact be smooth enabling the transfer of color imagines and as will be, described later, may be used as a power source for animating a toy. It should also be noted that the cylinder can contain voids utilizing a conventional construction wherein the one base of the circular member is open and the lateral surfaces are thin. Additionally, the only operation which is not possible with the circular member is the extrusion through the void.

As illustrated in FIGS. 32–34, means are provided for attaching a rotary disc to device 50. In the embodiment illustrated in FIGS. 32–34, rotary disc 140 consists of a thin planar disc 140 having cavitites 90 and voids 141 formed proximate its periphery. Rotary disc 140 also has aperture 142 centrally located at equal distances from its periphery. As with other attachments to device 50, rotary disc 140 is capable of performing nearly all operation that have been previously described. In that regard, as with the rotary attachment, rotary disc 140 is a special means for receiving 62. As illustrated by FIG. 34, color transfer of FIGS. 108*a* and 108*b* laced on one surface of rotary disc 140 by pen 109 are transferred to a strip of flowable material 91 as mirror images 108*c* and 108*d* of FIGS. 108*a* and 108*b*. It should be pointed out that rotary disc 140 can have voids, cavities, protrusions, or any combination thereof forming words, letters, animals, etc. on its surface or it can have a smooth surface.

As best illustrated in FIG. 32, rotary disc 140 having cavities 90 located in the surface positioned such that the open portion of cavity 90 contacts topwall 75 of device 50 provides for the transfer of images onto flowable material strip 91.

Figure 40:
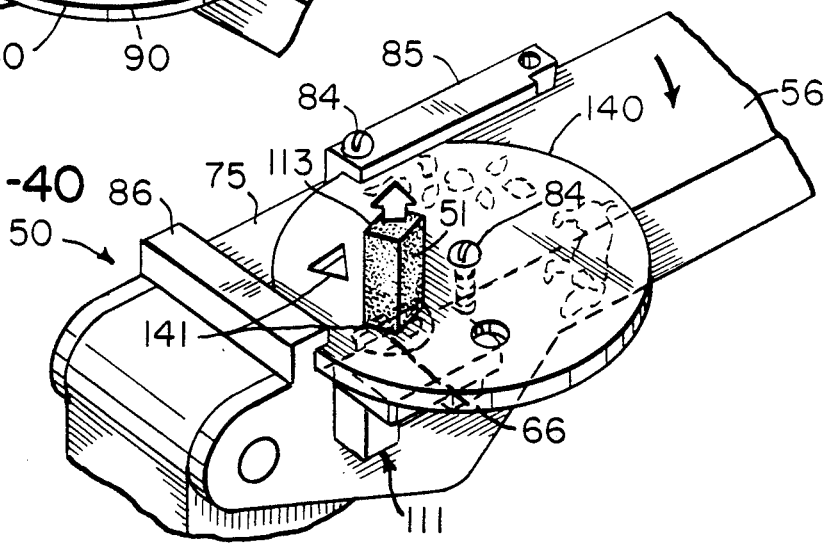
FIG. 40 is a partial perspective view of the device of FIG. 21 extruding through a void in the rotary disk.

As best illustrated in FIG. 40, void 141 of rotary disc 140 is positioned directly above means for transferring 66 as in FIGS. 19–21, such that flowable material 51 can be extruded utilizing extrusion attachment means 111 through void 141 forming an elongated cross-section of flowable material 113.

As best illustrated in FIG. 33, during operation of device 50 prior to attaching rotary disc 140, it is necessary to remove retaining means 84, of means for guiding 85 of device 50 and move means for guiding 85 such that it is approximately perpendicular to its companion means for guiding member 86. Retaining means 84, which was removed from means for guiding member 85, is utilized to securely but movably attach rotary disc 140 to device 50. At this point only one method of attaching disc 140 to device 50, is illustrated. It should be understood that other conventional methods of attaching rotary disc 140 are possible. As illustrated in FIG. 32, once rotary disc 140 is attached to device 50, as previously described, flowable material 51 is loaded into device 50. As illustrated in FIG. 32, as lever means 56 is urged toward means for supporting 52, flowable material 51 exits means for transferring 66 contacting rotary discs 140 thereby rotating rotary disc 140 in a counter clockwise direction and simultaneously forming impressions in a thin strip of flowable material 91. As stated above and as illustrated in FIG. 34, it is also possible to transfer color images as mirror images onto the surface of the strip of flowable material 91 as described earlier.

Referring now to FIG. 40, extrusion attachment means 111 is first attached to device 50 and void 141 is positioned directly above means for transferring 66. As lever means 56 is urged toward means for supporting 52, flowable material 51 is first forced into means for transferring 66, then into extrusion attachment means 111 and finally into void 141 forming elongated geometrical configuration 113. Attachment means 84 may be adjusted to more or less firmly position rotary disc 140 into or out of contact with both extrusion attachment means 111 and topwall 75 of device 50.

As illustrated in FIGS. 35–39, device 50 is modified by eliminating means for transferring 66 and replacing it with orifice 150 in topwall 75. Orifice 150 can be located anywhere in topwall 75 of device 50 but is preferably positioned mid-way between side wall 73 and 74 and mid-way between the inside edges of means for guiding 64.

Device 50 as modified above, can be utilized as an extruder merely by placing a means for receiving 62 as illustrated in FIG. 17, containing void 182 in means for guiding 64. With one of the voids 182 of means for receiving 62 positioned directly above orifice 150, elongated geometrical shaped figures 113 corresponding to the shape of void 182, similar to that illustrated in FIG. 19, can be produced by modified device 50.

Figure 39:
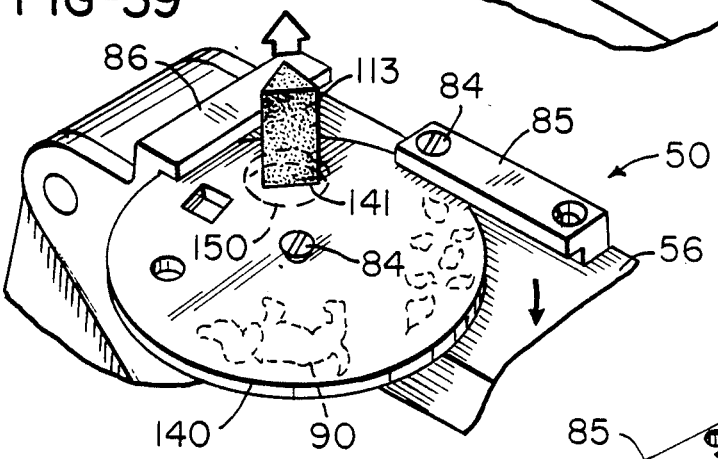
FIG. 39 illustrates extrusion through a void in a rotary disk attached to the extruder of FIG. 35.

Additionally, as best illustrated by FIG. 39, rotary disc 140 can be attached to modified device 50 of FIG. 35 and elongated geometrically shaped figure 113 can be extruded thru void 141 positioned over orifice 150.

As illustrated in FIG. 35, means are provided for converting modified device 50 to perform comparatively to device 50 as illustrated in FIGS. 1-6. In the embodiment illustrated in FIG. 35, this consists of means for converting 160 composed of member 162 with means for positioning 161 engaging side wall 74 of device 50 and providing for the positioning of orifice 168 above orifice 150 in topwall 75. Planar member 162 has means for guiding 163 and 164 securely, operatively attached at its periphery parallel to original means for guiding 64 of device 50. Means are provided for securely but removeably attaching means for converting device 160 to device 50 of FIG. 35. In the embodiment illustrated, this consists of flanges 165 and 166 adapted to releasably but securely fit into means for guiding 64. Planar member 162 contains orifice 168 corresponding to orifice 150. Void 168 is bounded by topwall 169 positioned directly above orifice 150. Notch 170 cut from top wall 169 allows orifice 168 to communicate outside the area defined by orifice 168. Notch 171 is cut from planar member 162 and together with notch 170 forms means for transferring 172 directly corresponding with means for transferring 66 of device 50.

As illustrated in FIG. 35, during operation of modified device 50, means for conversion 160 is slideably but securely mounted in means for guiding 64 by flanges 165 and 166 such that positioning means 161 contacts side wall 74 of modified device 50. Once means of conversion 160 is so positioned with respect to modified device 50, orifice 168 is located directly above orifice 150. As lever means 56 is urged toward means for supporting 52, flowable material 51 is forced thru orifice 150 into orifice 168. Upon further urging of lever means 56 toward means for supporting 52, flowable material 51 is forced to exit means of transferring 172. As best illustrated in FIG. 36, flowable material 51 is shown exiting means of transferring 172 much the same as flowable material 51 is illustrated exiting means of transferring 66 illustrated in FIG. 6.

All previous operations illustrated except the rotary disc can easily be performed with means for converting 160 positioned in the device of FIG. 35. However, it is possible to modify means for converting 160 so that rotary disc 140 could be attached to means for converting 160 and operate much the same as the embodiment illustrated in FIG. 32.

Means are provided for modifying rotary attachment 120 of FIG. 26. into a device for animating various attachments. In the embodiment illustrated in FIG. 41, one embodiment of an apparatus for simultaneously propelling and forming impressions in flowable material, device 50 utilizing a means for animation attachment, generally designated 300, is illustrated. Means for animation attachment 300 consists of the basic rotary attachment 120, as illustrated in FIG. 26, with the addition of linking means 318, connecting means 316 and 320 and animated member 306.

Figure 41:
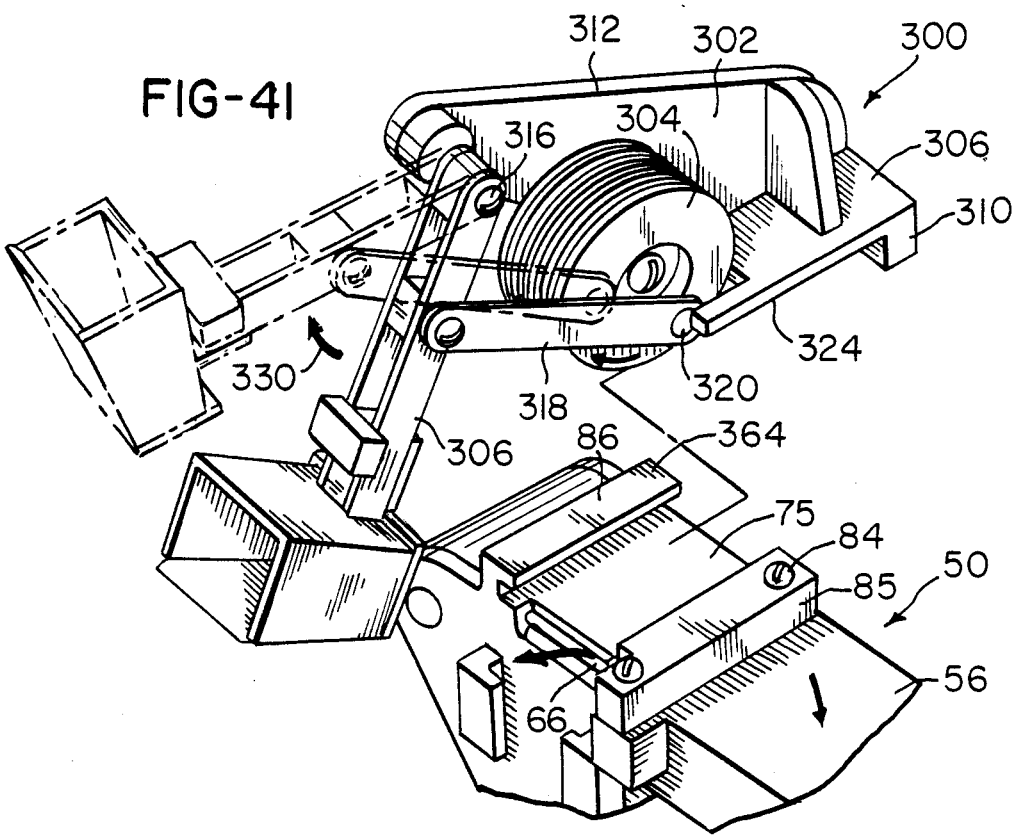
FIG. 41 is a partial fragmentary perspective view of the preferred embodiment of FIG. 1 with an animated device attached.

As illustrated in FIGS. 26 and 41, means for animation attachment 300 consisting of elements which corresponding to elements of FIG. 26. Specifically, means for embossing 122 or, as illustrated in FIG. 26, corresponds to means for animating 304 as illustrated in 41; and means for attaching 124, as illustrated in FIG. 26, corresponds to means for attaching 306 as illustrated in FIG. 41; means for positioning 126 as illustrated in FIG. 26, corresponds to means for positioning 302 as illustrated in FIG. 41; and means for rotating 130, as illustrated in FIG. 26, corresponds to means for rotating 314 as illustrated in FIG. 41.

As stated above, means for animation attachment 300 adds linking means 318 and connecting means 316 and 320 which link animated member 306 to means for animating 304. Animated member 306 is connected both to means for positioning 302 and means for rotating 304 by linking pin connecting means 320 connecting linking means 318 connects means for rotating 304 and animated member 306. Animated member 306 is further connected to means for positioning 302 by pivoting means 316. Means for animation attachment 300 when positioned in means for guiding 64, as previously discussed in connection with rotary attachment 120 for the rotary attachment 120, operates in the same manner except that the energy from flowable material 51 exiting means for transferring 66 striking means for animating 304 at a contact point on the periphery of means for animating 304 such that means for animating 304 is rotated in a clock-wise direction. Animated member 306 is moved between the positions indicated by the arrow 330 by means for linking 318. As flowable material 51 exit means for transferring 66 contacting means for animating 304 and thereby imparting a clock-wise rotational movement to means for animation 304, flowable material 51 preferrably falls by force of gravity to the surface supporting device 50.

While the above means for animating attachment 300 has been described in conjunction with a specific embodiment, it is understood that there are numerous animation means and animation members possible other than the cylinder illustrated. Specifically, pleated belts or other belt type mechanisms, gears, cams or pulleys in various combinations are also capable of animating a shovel or other device. It should be apparent from the above description that a flowable material possesses the ability to impart motion to freely movable surfaces. It is understood that the above illustrations in combination with the appended claims are intended to encompass all such possibilities.

Figure 43:
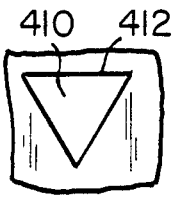
Figure 44:
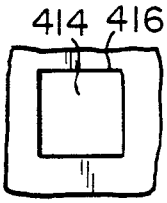
Figure 45:
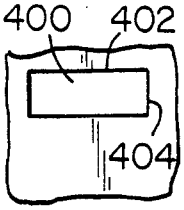

Referring now the FIGS. 42-46, cross-sections for means for transferring 66 are illustrated. As illustrated by FIG. 45, the preferred cross-sectional configuration 400, of means for transferring 66, 172 and/or 266, is illustrated. Cross-section 400 is rectangular in shape with top edge 402 contacting the appropriate surface of means for receiving 62, 140, 122, or 304 during operation of device 50. The width of the cross-section 404 is preferrably less than half the length of edge 402.

Figure 42:
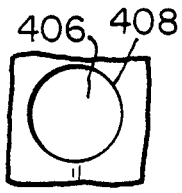
FIGS. 42–46 illustrate different cross sections of flowable material as it exits the means for transferring of the preferred embodiment of FIG. 1 and the extruder conversion attachment of FIG. 35.

FIGS. 42-44 and 46 illustrate alternate embodiments which may be used as the cross-section at exit of means for transferring 66, 172 or 266. Specifically, FIG. 42 illustrates circular cross-section 406 with edge 408 contacting the appropriate bottom surface of means for transferring 62 or one of the other embodiments of means for receiving 122, 140 or 304. While not performing as satisfactorily as the cross-section illustrated in FIG. 45, circular cross-section 406 is capable of performing all functions earlier described.

Referring now to FIG. 43, a triangular cross-section 410 is illustrated. Surface 412 of cross-section 410 contacts the appropriate bottom surface of means for receiving 62 or one of the other embodiment of means for receiving 122, 140 or 304. Likewise, as with FIG. 42, the circular cross-section 406, the triangular cross-section 410 of FIG. 43 does not perform as well as the rectangular cross-section 400 of FIG. 45.

Referring now to FIG. 44, a square cross-section of means of transferring 66, 172 or 266 is illustrated. Any of the four sides of cross-section 414 can be utilized to contact the lower surface of means for receiving 62 or the point of contact any of the other attachments. However, as illustrated in FIG. 44, surface 416 would preferably be the contacting surface. As with the previously described circular cross-section 406, and triangular cross-section 410, square cross-section 414 does not perform as efficiently as rectangular cross-section 400 of FIG. 45.

Figure 46:
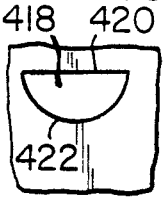

Referring now to FIG. 46, the final cross-sectional configuration of means for transferring 66, 172 or 266 half moon cross-sectional configuraion 418 is illustrated. Preferrably top surface or planar surface 420 is the surface of cross-section 418 which contacts the bottom surface 63 of means for receiving 62 or the surface contacting the means for animation or other circular or rotary disc attachments. However, it is possible to utilize surface 422, the half moon portion of cross-section 418, the semi-circular portion of the half moon configuration 418, to contact the various means for receiving surfaces. As with all other illustrations in comparison with the rectangular configuration 400 of FIG. 45, the half moon cross-section 418 is not as efficient as the rectangular cross-section 400.

While various embodiments of the present invention have been illustrated and described, it will be obvious to those skilled in the art that various changes and modifications may be made without departing from the invention, and it is intended to cover in the appending claims all such changes and modifications that fall within the true spirit and scope of the invention.

What is claimed is:

1. A method of forming impressions in a flowable material utilizing a device having a lever means, a means for positioning, a means for supporting, a piston means, a means for storing, a means for guiding and a means for transferring for simultaneously propelling and forming impressions in combination with a means for receiving, said method comprising the steps of:

rotating said lever means of said device upward away from said means for supporting said device;

positioning said flowable material in said means for storing;

urging said lever means toward said means for supporting said device such that said flowable material is compressed in said means for storing, whereby said flowable material is forced into said means for transferring;

positioning said means for receiving such that said flowable material contacts said means for receiving; and further urging said lever means toward said means for supporting said device whereby said flowable material if forced first into and then out of said means for transferring, said flowable material contacting at least one surface of said means for receiving, upon exiting said means for transferring at an angle greater than 0° but less than 90°, said flowable material contacts said means for receiving, such that said means for receiving is propelled in the direction of the acute angle that said flowable material is forced from said means for transferring.

2. A method as recited in claim 1, further comprising the step of:

separating said flowable material from said surface of said means for receiving, if said flowable material is adhering thereto, revealing an impression formed in said surface of said flowable material which contacted said means for receiving.

3. A toy device which utilizes a flowable material to propel a means for receiving and form impressions on said flowable material with said means for receiving, said propelling of said means for receiving and said forming of said impressions being accomplished simultaneously, said toy device comprising:

means for supporting said toy device;

piston means, said piston means being operatively connected to said means for supporting said toy device;

lever means, said lever means being operatively connected to said toy device;

means, operatively connecting said lever means to said piston means, for pivoting said lever means about said piston means;

means for storing said flowable material;

means, operatively connected to said toy device, for receiving said flowable material and having an operative surface;

means, operatively connected to said toy device, for guiding said means for receiving; and means, operatively connected to said toy device, for transferring said flowable material from said means for storing to said means for receiving, whereby said transfer of said flowable material propels said means for receiving and simultaneously provides for the formation of impressions on said flowable material by said means for receiving.

4. A toy device as recited in claim 1, wherein said means for guiding is operatively connected to said lever means.

5. A toy device as recited in claim 1, wherein said means for transferring is operatively connected to said lever means.

6. A toy device as recited in claim 3, wherein said means for storing is operatively connected to said lever means.

7. A toy device as recited in claim 3, wherein said means for guiding is operatively connected to said piston means.

8. A toy device as recited in claim 3, wherein said means for transferring is operatively connected to said piston means.

9. A toy device as recited in claim 3, wherein said means for guiding is adapted so that an alternate means of receiving can be operatively connected to said toy device.

10. A toy device as recited in claim 3, wherein as said lever means is pivoted toward said means for supporting, said flowable material is compressed in said means for storing such that said flowable material is forced to exit said means for transferring.

11. A toy device as recited in claim 3, wherein said means for transferring said flowable material further comprises:

nozzle means, said nozzle means being operatively connect to said toy device so that when said lever means is pivoting about said means for pivoting, said flowable material exits said nozzle at an angle greater than 0° but less than 90° relative to the plane of said means for receiving said flowable material, said nozzle means directing said flowable material into the plane of said top wall thereby contacting said means for receiving.

12. A toy device as recited in claim 3, which said flowable material contacts said means for receiving upon exiting said means for transferring at an angle greater than 0° but less than 90° so that said means for receiving is propelled in the direction of the acute angle that said flowable material if forced from said means for transferring.

13. A toy device as recited in claim 3, wherein said means for receiving has at least one cavity operatively formed thereon.

14. A toy device as recited in claim 3, wherein said means for receiving has at least one protrusion operatively formed thereon.

15. A toy device as recited in claim 3, wherein said means for receiving has at least one void operatively formed thereon.

16. A toy device as recited in claim 3, wherein said means for receiving further comprises:

means, operatively connected thereto for animating a separate toy device.

17. A toy device as recited in claim 3, wherein the operative surface of said means for receiving is substantially smooth.

18. A toy device as recited in claim 17, wherein said substantially smooth operative surface of said means for receiving operatively transfers color to said flowable material.

19. A toy device as recited in claim 3, wherein said means for receiving further comprises:

a strip, said strip being freely slideably, operatively connected to said means for guiding.

20. A toy device as recited in claims 3, wherein said means for receiving further comprises:

a rotary disc; and means for operatively connecting said disc to said toy device.

21. A toy device as recited in claim 3, wherein said means for receiving said flowable material further comprises:

means for embossing said flowable material;

means for operatively positioning said means for embossing in said means for guiding, said operative position being proximate said means for transferring; and means for freely, operatively rotating said means for embossing operatively positioned proximate said means for transferring by said means for positioning such that said flowable material contacts the surface of said means for embossing thereby causing said means for embossing to rotate about said means for freely, operatively rotating said means for embossing.

22. A toy device as recited in claim 3, said toy device further comprising:

means for extruding said flowable material; and means for operatively connecting said means for extruding to said toy device.

23. A toy device as recited in claim 22, said toy device further comprising:

means for embossing said flowable material;

means for operatively connecting said means for embossing to said means for guiding, said operative connection positioning said means for embossing proximate said means for extruding; and means for freely rotating said means for embossing proximate said means for extruding by said means for positioning such that said flowable material operatively contacts said surface of said means for embossing thereby causing said means for embossing to rotate about said means for freely rotating.

24. A toy device as recited in claim 13, wherein as said flowable material exits said means for transferring, said flowable material operatively contacts the bottom surface of said means for receiving, such that said flowable material occupies at least one cavity.

25. A toy device as recited in claim 24, wherein said cavity forms at least one protrusion on at least one surface of said flowable material.

26. A toy device as recited in claim 3, wherein upon contacting said means for receiving, said flowable material adhering to the contacted surface of said means for receiving, said flowable material forming a thin strip of flowable material, whereby upon separation of said thin strip from said contacted surface of said means for receiving an impression is formed on the contacted surface of said thin strip of flowable material.

27. A toy device as recited in claim 25, wherein after contacting said means for receiving and forming said impression, said flowable material falls by force of gravity to the contacted surface supporting said toy device, said impression being retained on said surface of said thin strip of said flowable material.

28. A toy device as recited in claim 3, wherein said impression is shaped like a head.

29. A toy device as recited in claim 3, wherein said impression is shaped like a abdomen.

30. A toy device as recited in claim 3, wherein said impression is shaped like legs.

31. A toy device as recited in claim 3, wherein said impression is combinable with at least one additional impression formed from at least one other means for receiving to form a single impression.

32. A toy device as recited in claim 3, wherein a plurality of cavitites are operatively formed in said means for receiving, said impressions formed by said cavities being operatively combined to form a complete picture.

33. A toy device as recited in claim 3, wherein a plurality of said means for receiving have a plurality of said cavities operatively formed thereon, said impressions being selectively operatively combined to form a plurality of complete pictures.

34. A device for simultaneously propelling and forming impressions with a flowable material as recited in claim 3, wherein said impression is shaped like animals.

35. A device for simultaneously propelling and forming impressions with a flowable material as recited in claim 3, wherein said impression is shaped like geometrical designs.

36. A toy device as recited in claim 21, wherein said means for receiving said flowable material further comprises:

means for linking;

means for connecting; and animated member means, said means for connecting operatively connecting said animated means and said means for linking.

37. A toy device for extruding flowable material, comprising:

means for supporting said toy device;

piston means, said piston means being operatively connected to said means for supporting said toy device;

lever means;

means, operatively connected to said toy device, for pivoting said lever means about said piston means, said means for pivoting operatively connecting said lever means to said piston means;

means, operatively connected to said toy device, for storing said flowable material;

means for transferring said flowable material outside said means for storing as said flowable material is compressed in said means for storing by said piston means and;

means, operatively connected to said lever means, for extruding, said means for extruding having at least one orifice, said orifice being positioned over said means for transferring during the extrusion of said flowable material;

and a means for converting the toy device for extruding flowable material into a device which utilizes a flowable material to propel a means for receiving and simultaneously form impressions on said flowable material by said means for receiving.

38. A toy device as recited in claim 37, said means for extruding, further comprising:

means for positioning said means for extruding, said means for positioning operatively positioning said means for extruding firmly in place over said means for transferring.

39. A toy device as recited in claim 38, wherein said means for positioning further comprises:

two parallel members, said parallel members being spaced apart approximately the width of said means for extruding, said members providing clearance above said means for transferring such that said means for extruding is securely but releasably retained in position over said means for extruding.

40. A toy device as recited in claim 37, wherein said means for extruding further comprises:

a rotary disc.

41. A toy device as recited in claim 33, wherein said means for extruding further comprises:

a strip.

42. A toy device as recited in claim 37, said toy device further comprising:

means for positioning a rotary disc.

43. A toy device as recited in claim 37, wherein said means for converting said device further comprises:

means for guiding said means for receiving said flowable material; and means, operatively connected to said means for converting, for transferring said flowable material to said means for receiving said flowable material.

44. A toy device as recited in claim 43, wherein said means for transferring further comprises:

at least one planar member, said planar member having an orifice corresponding to said means for transferring said flowable material outside said means for storing, said orifice of said planar member operatively connecting said means for storing to a means for transferring said flowable material, said means for transferring being located at the periphery of said planar member containing said orifice; and means for accurately, operatively positioning said means for converting in said means for guiding, said means for positioning being operatively connected to said means for converting.

45. A toy device as recited in claim 43, further comprising:

means for embossing, wherein said means for embossing is said receiving means;

means for positioning said means for embossing in said means for guiding, said means for embossing being operatively located proximate said means for transferring; and means for freely rotating said means for embossing while said means for embossing is located proximate said means for transferring such that said flowable material contacts said means for embossing thereby causing said means for embossing to rotate.

46. A toy device as recited in claim 43, said toy device further comprising:

means for animating, wherein said means for animating is said receiving means;

means for supporting said means for animating in said means for guiding; and animated means, said animated means being operatively connected to said means for animating.

47. A toy device as recited in claim 11, wherein said nozzle means has at least one flat portion for contacting said bottom surface of said means for receiving.

48. A toy device as recited in claim 11, wherein said nozzle means has at least one circular cross-section, for contacting said bottom surface of said means for receiving.

* * * * *